United States Patent [19]

Mowbray et al.

[11] Patent Number: 4,526,519

[45] Date of Patent: Jul. 2, 1985

[54] RECIPROCABLE PLUNGER FUEL INJECTION PUMP

[75] Inventors: Dorian F. Mowbray, Burnham; James C. Potter, London, both of England

[73] Assignee: Lucas Industries, Birmingham, England

[21] Appl. No.: 515,186

[22] Filed: Jul. 19, 1983

[30] Foreign Application Priority Data

Aug. 3, 1982 [GB] United Kingdom ..... 8222349

[51] Int. Cl.[3] ..... F04B 7/04; F04B 39/10

[52] U.S. Cl. ..... 417/490; 239/88; 239/95

[58] Field of Search ..... 417/490, 494, 499, 440, 417/493, 505; 123/508, 509, 495; 239/88-95

[56] References Cited

U.S. PATENT DOCUMENTS

| | | | |
|---|---|---|---|
| 2,372,694 | 4/1945 | Tabb | 417/499 |
| 4,073,277 | 2/1978 | Eheim | 417/505 |
| 4,244,520 | 1/1981 | Rathmayr | 239/88 |

FOREIGN PATENT DOCUMENTS

| | | | |
|---|---|---|---|
| 617182 | 7/1935 | Fed. Rep. of Germany | 123/495 |
| 2055985 | 3/1981 | United Kingdom | 123/508 |

*Primary Examiner*—Leonard E. Smith
*Assistant Examiner*—Jane E. Obee

[57] ABSTRACT

A reciprocable plunger fuel injection pump includes a plunger mounted in a pump barrel. A spring abutment is secured to the plunger and is engaged by one end of a spring the other end of which engages a further spring abutment slidable about the barrel. The barrel is provided with transverse apertures which locate balls which are held in an operative position by the abutment. The balls can be engaged by a step on the plunger to limit the outward movement of the plunger.

7 Claims, 4 Drawing Figures

RECIPROCABLE PLUNGER FUEL INJECTION PUMP

This invention relates to a reciprocable plunger fuel injection pump of the kind comprising a body, a plunger mounted in a bore in the body, said plunger extending from the body and having a spring abutment secured thereto, a coiled compression spring urging said abutment away from the body and a thrust member actuated in use by a component of an associated engine for imparting inward movement to the plunger against the action of said spring.

Such pumps are well known in the art and have an outlet communicating with the bore, the outlet being connected to a fuel injection nozzle. The nozzle may be mounted in assembly with the pump or it can be located remote from the pump and connected to the outlet by means of a pipe. The bore is often provided with a port in its wall and this is connected to a source of fuel. The port is covered by a plunger during the inward movement of the plunger and when the port is covered the fuel in the bore is pressurized and displaced through the outlet. It is important that the plunger should be correctly set in relation to the rotary parts of the associated engine and for this purpose if the aforesaid component of the engine is a rocker, some form of screw adjustment means can be provided. If the component is a cam of the engine then the adjustment is effected using shims. In each case it is essential that the plunger should be capable of being set in a known position in the bore before adjustment is effected.

It is known to utilise gauges for this purpose but such gauges are usually separate items which can be damaged and also lost. It is also known to engage a peg carried by the body within a groove in the plunger but it is not always easy to find sufficient room to locate the peg at a position where it is convenient to operate.

The object of the present invention is to provide a pump of the kind specified in a simple and convenient form.

According to the invention a pump of the kind specified comprises a further spring abutment mounted about said body and slidable axially thereon, a transverse aperture in the wall of the body, a stop piece slidable within said aperture, said stop piece having a length greater than the length of said aperture and a step defined on the plunger, said stop piece being held in position to engage said step by the further spring abutment thereby to determine the outermost position of the plunger.

Figure 1:
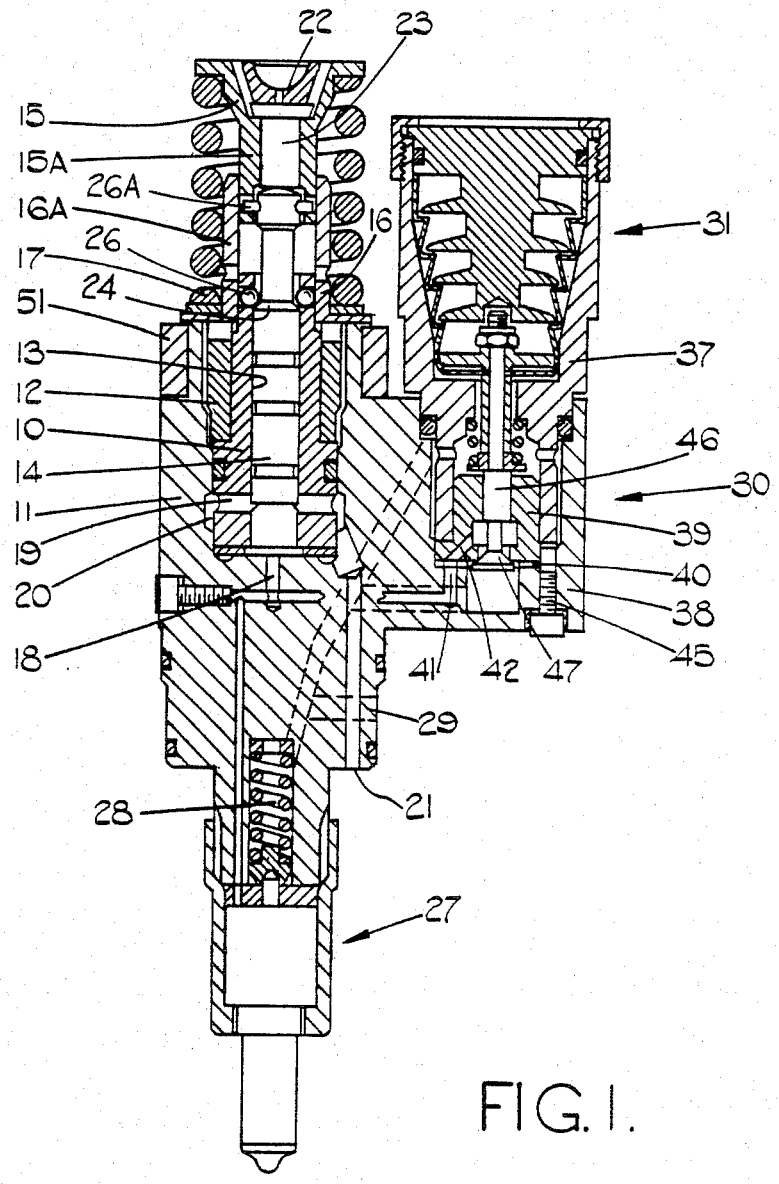
Figure 2:
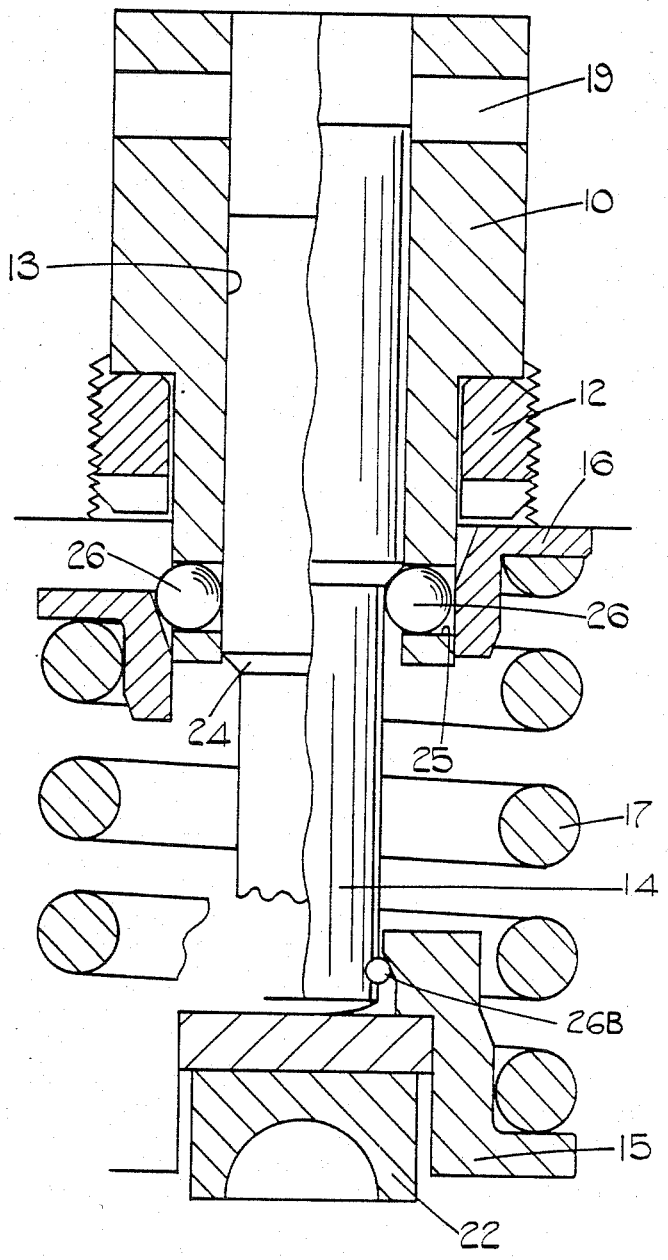
Figure 3:
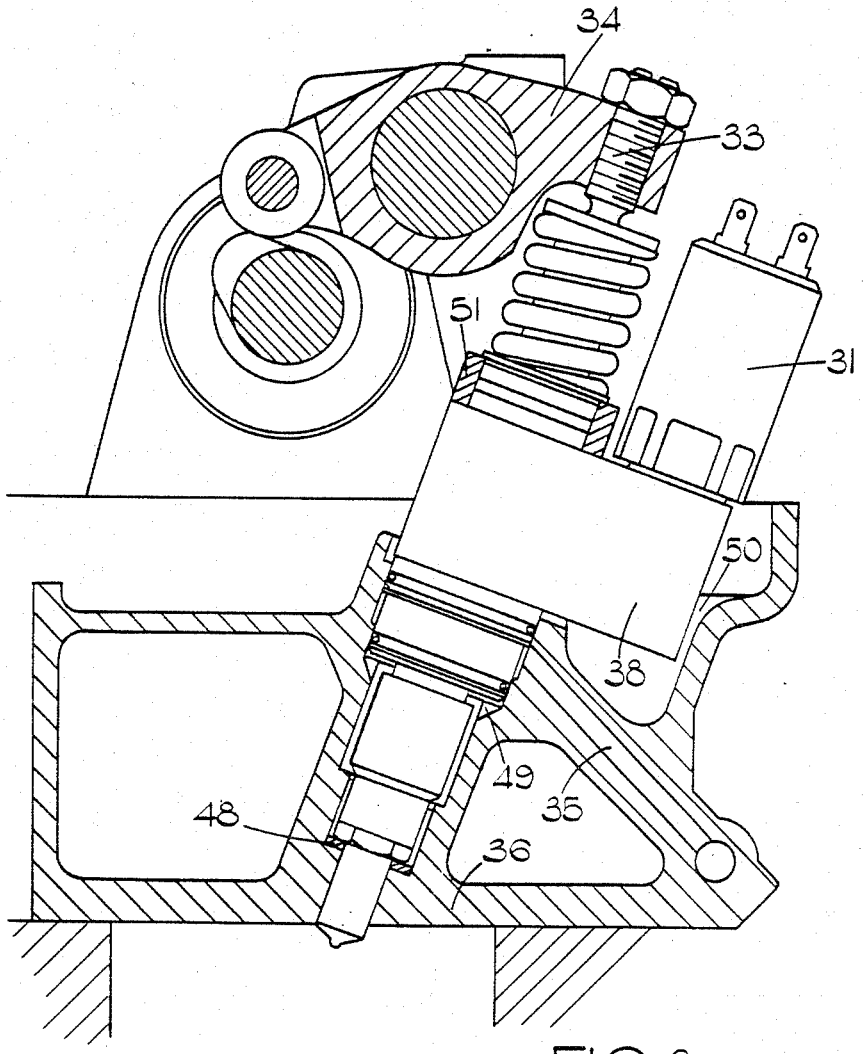
Figure 4:
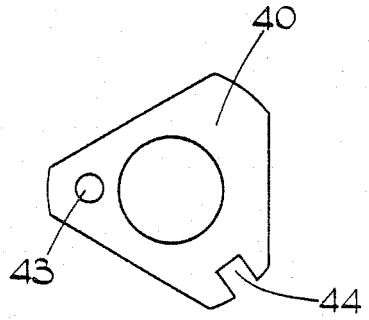

An example of a pump in accordance with the invention will now be described with reference to the accompanying drawings, in which:

FIG. 1 is a sectional side elevation of a so-called pump/injector embodying the invention, FIG. 2 is an inverted view to an enlarged scale of a modification of the pump seen in FIG. 1 and with some of the components shown in two different positions, FIG. 3 shows the mounting of the pump/injector to an engine cylinder head, and FIG. 4 shows the shape of a washer forming part of the pump/injector.

Referring to FIG. 1 of the drawings the pump comprises a pump body 10 which is often known in the art as a barrel. The barrel is located within a recess formed in a housing 11, by means of a retaining nut 12 which engages a flange on the barrel and urges one end face of the barrel into sealing engagement with the end face of the recess. Formed in the barrel is a bore 13 in which is slidable a plunger 14. The plunger extends from the end of the bore in the barrel and mounts spring abutment 15. In addition, the skirt of the barrel extends from the housing and is surrounded by a further spring abutment 16. The spring abutment 15 includes a hollow cylindrical portion 15A which is slidable within a hollow cylindrical extension 16A of the spring abutment 16. Extending between the spring abutments is a coiled compression spring 17 which acts as will be described, to effect outward movement of the plunger 14.

The bore 13 communicates with an outlet 18 and opening into the bore is a pair of ports 19 which communicate with a fuel supply gallery 20 defined in the recess. The gallery 20 communicates with a fuel inlet 21.

The abutment 15 is provided with a recess and is also hollow. Located in the bore in the spring abutment 15 is a cylindrical member 23 which has a flat head forming the base wall of the recess, and located in the recess is a thrust member 22 which is slidable on the head of the member. The thrust member has a spherical recess in which in use is located the spherical end of an adjusting screw 33 carried by a rocker arm 34 (FIG. 3) actuated by an engine driven cam. As the rocker arm moves the thrust member can slide on the surface of the head of the member 23 and the thrust member can pivot relative to the screw. The transmission of side thrust to the spring abutment is minimised. Outward movement of the plunger is effected through a pin and slot connection 26A between the plunger and the spring abutment 15. The slot which is formed in the hollow cylindrical portion 15A of spring abutment 15 is slightly larger than the pin which is carried by the plunger and acts to allow limited relative axial movement between the plunger and the abutment. A slightly modified version of the arrangement is shown in FIG. 2 where the spring abutment 15 is retained on the plunger by a circlip 26B and the thrust member 22 carried by the abutment 15, engages the plate directly engaged by the plunger.

Referring now to FIG. 2, the plunger 14 is provided with a step 24 and the barrel 10 is provided with a plurality of cylindrical apertures 25 in that portion thereof which extends beyond the housing and is covered by the spring abutment 16. Located in the apertures are stop pieces respectively in the form of balls 26. The diameters of the balls are larger than the axial lengths of the apertures 25 and in the fully assembled condition as shown in FIG. 1 and in the right-hand portion of FIG. 2, the balls 26 locate against the step 24 to limit the extend of outward movement of the plunger. Since the abutment 15 is retained relative to the plunger in the fully assembled position, the balls 26 also prevent the plunger and the abutment 15 together with the spring 17, becoming detached from the body 10. The left-hand portion of FIG. 2 shows the assembly of the various components and initially the plunger 14 is assembled with the spring abutment 15, the spring 17 and the abutment 16. The plunger is then partly assembled into the bore 13 and before the apertures 25 are covered by the spring abutment 16, the balls 26 are located in the apertures. The plunger is now moved further inwardly to the position shown in the left-hand portion of FIG. 2. It will be noted that the spring abutment 16 has a flared end portion to its central bore and the effect of this flared portion is to impart a thrust to the balls in a direction transverse to the axis of movement of the plunger. As the plunger is moved inwardly the spring 17 will be compressed and as soon as the step 24 passes beyond the balls, the latter will be urged inwardly to the position shown in FIG. 2. Furthermore, the spring abutment 16 can now slide axially to cover the apertures 25 in which the balls are located. It is arranged that the spring 17 is lightly stressed in the fully assembled state and this has the effect of maintaining the spring abutment 16 in position so as to prevent the balls 26 moving outwardly. The positions of the step 24 and of the apertures 25 are carefully chosen since the co-operation of the balls 26 with the step 24 determines the maximum outward movement of the plunger. Moreover, the plunger and the barrel 10 are accurately machined so that when the balls are located against the step 24 the plunger position assumes a known position in which it will be noted, the port 19 is substantially uncovered. Thus when the pump is assembled to the engine, the appropriate adjustment can be effected once the engine has been set to the correct position.

Returning now to FIG. 1, the housing 11 mounts a fuel injection nozzle 27 and the outlet 18 is connected to the fuel inlet of the injection nozzle. The nozzle includes a spring loaded valve member, the spring being housed within a chamber 28 defined in the housing. This chamber is connected to a suitable drain port 29 opening onto the periphery of the housing and as shown in FIG. 3, this drain port is open to a suitable passage 35 formed in the cylinder head 36 of the engine so that the fuel which flows through the port can be returned to the supply tank.

If at any time during the life of the pump/injector, it is required to replace the plunger and also the barrel 10, due, for example, to wear, it is necessary to displace the spring abutment 16 to permit the balls to move outwardly within the apertures 25 and thereby permit further outward movement of the plunger. This can be effected by displacing the abutment 16 against the action of the spring.

The pump/injector shown in FIG. 1 is of the type in which the quanity of fuel supplied through the nozzle and also the timing of delivery of fuel, is controlled by a spill valve generally indicated at 30 and controlled by an electromagnetic actuator generally indicated at 31. The valve 30 controls the flow of fuel between the outlet 18 and the drain port 29 and when the valve is closed upon energisation of the actuator 31, the fuel flowing through the outlet 18 flows to the nozzle and the associated engine. If the valve 30 is opened while the plunger 14 is moving inwardly, the fuel which is displaced by the plunger will flow to the drain port.

The valve 30 includes a valve body 37 which is screwed into an extension 38 of the housing 11. The body acts to retain against a step defined in a recess in the housing, a flanged sleeve 39. A washer 40 is interposed between the sleeve and the step, the washer having the outline shape shown in FIG. 4. Opening onto the step is a port 41 connected to the pump outlet 18 and this port communicates with an enlargement in the bore in the sleeve, by way of a passage 42 in the sleeve. The washer 40 is provided with an aperture 43 to permit fuel flow and in addition it has a locating slot 44 which engages with a dowel 45 carried by the extension 38 and extending into a locating slot in the sleeve 39. The narrower portion of the recess communicates with the port 29 and the bore in the sleeve mounts a slidable valve member 46 having a head 47 which can be urged into contact with a seating by energisation of the actuator 31, to prevent spillage of fuel from the pump.

As shown in FIG. 3 the lower portion of the housing together with the nozzle 27 are located within a generally complementary recess in the cylinder head of the engine. The end portion of the nozzle extends into the combustion chamber of the engine and a washer 48 prevents escape of gas from the combustion chamber into the bore. The housing 11 on opposite sides of the port 29 mounts "O" ring seals which co-operate with the wall of the bore to prevent fuel escaping from the port leaking from the upper end of the bore and also leaking into a chamber 49 defined between a part of the bore and the housing. This chamber is connected to a source of fuel and the fuel inlet 21 is in communication with the chamber 49.

The extension portion 38 of the housing is located in a recess 50 defined in the cylinder head and the pump/injector is retained in position by a clamping ring 51.

We claim:

1. A reciprocal plunger fuel injection pump of the type which has a body, a plunger mounted within a bore defined in that body and adapted to move into and out of the bore and having a thrust member mounted thereon to cooperate with an associated engine component to move the plunger into the bore, comprising:

means for attaching the plunger to the body and simultaneously setting the plunger in a precisely determined position in the body bore, said means including a first abutment means mounted on the plunger with which the thrust member cooperates to move the plunger, a spring means surrounding the plunger and engaging said first abutment means for biasing the plunger outwardly of the body bore, a second abutment means contacting said spring means and being located adjacent to the plunger, a bore defined in the body to be adjacent to said second abutment means to have an axial length extending transverse to the plunger, a stop means located in said transverse bore and having a dimension as measured along the axial length of said bore which exceeds the axial length of said bore, first space defining means on the plunger located to cooperate with said bore for accommodating said stop means and holding said stop means in engagement with the body adjacent to said bore and also in engagement with the plunger for connecting the plunger to the body when the plunger is in a predetermined position with respect to the body whereat said bore and said space defining means become aligned, second space defining means on said second abutment means for accommodating said stop means when said first space defining means and said bore are not aligned, and holding said stop means in said bore and against the plunger at a location spaced from said first space defining means and permitting movement of the plunger with respect to the body, wherein said plunger is reciprocable in said body between an outermost and an innermost position said predetermined position of said plunger being the outermost position of the plunger.

2. A reciprocal plunger fuel injection pump comprising a body, a plunger mounted in a bore in the body, said plunger extending from the bore, a thrust member cooperating with an associated engine component and with said plunger to impart movement of said plunger into said bore, means for precisely positioning said plunger in said bore and for preventing said plunger from becoming detached from said body, said means including a spring abutment secured to said plunger, a coiled compression spring which is biased to urge said abutment away from the body, a further spring abutment mounted about said body and slidable axially thereon, said further spring abutment including a first wall extending adjacent to and spaced from said plunger to define a gap between said further spring abutment and said plunger and a second wall extending from said first wall away from said plunger, said body being interposed between said walls and said plunger with said first wall being in sliding contact with said body and said second wall diverging outwardly of said body to define an enlarging space between said body and said further spring abutment, a transverse aperture defined in the wall of the body, said transverse aperture being located in said body wall to cooperate with said further spring abutment first wall when said plunger is in a first position relative to said further spring abutment and to cooperate with said further spring abutment second wall when said plunger is in a second position relative to said further spring abutment, a stop piece located within said aperture, said stop piece having a dimension as measured in a radial direction of said plunger which is greater than the length of said aperture as measured in a radial direction of said plunger, and a step defined on the plunger to extend radially inwardly of said plunger to define a plunger wall which extends inwardly of said plunger from a plunger portion having a first diameter to a plunger portion having a second diameter with said first diameter being larger than said second diameter, said aperture and said further spring abutment first and second walls being located so said step cooperates with said further spring abutment first wall when said plunger is in said first position relative to said further spring abutment to define a space large enough to accommodate said stop piece and to hold said stop piece in engagement with said plunger wall whereby said plunger is locked into said first position, and said further spring abutment second wall cooperates with said aperture when said plunger is in said second position relative to said further spring abutment to define a space large enough to accommodate said stop piece and to hold said stop piece against said plunger first portion while permitting axial movement of said plunger relative to said further spring abutment, wherein said plunger is reciprocable in said body between an outermost and an innermost position said plunger first position being the outermost position of the plunger, said compression spring cooperating with said first and second spring abutments and said stop piece to prevent said plunger from becoming detached from the body when said plunger is in said outermost position.

3. A pump according to claim 1 in which said aperture is of cylindrical form, said stop piece comprising a ball having a diameter greater than the axial length of said aperture.

4. A pump according to claim 3 in which said first mentioned spring abutment is connected to said plunger by a pin and slot connection, the slot being slightly larger than the pin so as to allow limited relative axial movement of the abutment and plunger.

5. A pump according to claim 1 in which said further spring abutment is provided with a hollow cylindrical extension extending away from said body and the first mentioned spring abutment is provided with a hollow cylindrical portion which is slidable within said extension, whereby side thrust imparted to said first mentioned spring abutment will be absorbed by said further spring abutment.

6. A pump according to claim 1 in which said body comprises a pump barrel, a housing mounting said barrel, an outlet defined in the housing from the pump chamber formed by said barrel, a fuel inlet to said chamber, and an electrically operated spill valve connected to said outlet, said spill valve when open preventing flow of fuel from said outlet to a fuel injection nozzle.

7. A pump according to claim 6 including a fuel injection nozzle mounted on said housing.

* * * * *

UNITED STATES PATENT AND TRADEMARK OFFICE

CERTIFICATE OF CORRECTION

PATENT NO. : 4,526,519

DATED : July 2, 1985

INVENTOR(S) : Dorian F. Mowbray et al

It is certified that error appears in the above-identified patent and that said Letters Patent are hereby corrected as shown below:

On the title page, Item [73] should read:

[73] Assignee: LUCAS INDUSTRIES public limited company
Birmingham, England

Signed and Sealed this

*Fifteenth* Day of *July 1986*

[SEAL]

*Attest:*

DONALD J. QUIGG

*Attesting Officer*

*Commissioner of Patents and Trademarks*